US007129905B2

(12) United States Patent
Morioka

(10) Patent No.: US 7,129,905 B2
(45) Date of Patent: Oct. 31, 2006

(54) MULTIPLE BAND ANTENNA APPARATUS

(75) Inventor: Sosumu Morioka, Saitama (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 10/511,060

(22) PCT Filed: Feb. 18, 2004

(86) PCT No.: PCT/JP2004/001819

§ 371 (c)(1),
(2), (4) Date: Jun. 6, 2005

(87) PCT Pub. No.: WO2004/077612

PCT Pub. Date: Sep. 10, 2004

(65) Prior Publication Data

US 2005/0243003 A1 Nov. 3, 2005

(30) Foreign Application Priority Data

Feb. 28, 2003 (JP) ..... 2003-053541

(51) Int. Cl.
*H01Q 7/00* (2006.01)
*H01Q 21/00* (2006.01)

(52) U.S. Cl. ..... 343/866; 343/742; 343/867

(58) Field of Classification Search ..... 343/741, 343/742, 866, 867, 895
See application file for complete search history.

(56) References Cited

U.S. PATENT DOCUMENTS 2,009,087 A 7/1935 Kennedy et al.
4,839,594 A * 6/1989 Misic et al. ..... 324/318
5,248,989 A * 9/1993 Murdoch ..... 343/841
5,485,165 A * 1/1996 Foard ..... 343/741
5,564,082 A 10/1996 Blonder et al.
6,025,813 A * 2/2000 Hately et al. ..... 343/867
6,218,998 B1 * 4/2001 Van Voorhies ..... 343/741
6,252,550 B1 * 6/2001 Vernon ..... 343/700 MS
6,288,493 B1 * 9/2001 Lee et al. ..... 315/111.51

FOREIGN PATENT DOCUMENTS

JP 56122204 9/1981
JP 4-2002 B2 3/1986
JP 64-55720 A 3/1989
JP 07-321689 A 12/1995

* cited by examiner

*Primary Examiner*—Tan Ho
(74) *Attorney, Agent, or Firm*—Lerner, David, Littenberg, Krumholz & Mentlik, LLP

(57) ABSTRACT

An antenna apparatus capable of receiving AM radio broadcasting and FM radio broadcasting and being realized at a low cost includes an FM antenna conductor for receiving FM broadcasting formed with a metal pipe with good conductivity, and an AM antenna conductor for receiving AM broadcasting housed in an internal space of the antenna conductor, so as to unify an AM antenna and an FM antenna with a simple structure. The FM antenna conductor also functions as an electrostatic shielding member for the AM antenna conductor, so that high-frequency noise from other equipment is prevented from being received at the AM antenna conductor as interference noise without raising the cost.

3 Claims, 5 Drawing Sheets

MULTIPLE BAND ANTENNA APPARATUS

TECHNICAL FIELD

The present invention relates to an antenna apparatus provided with an antenna for receiving an FM broadcast wave and an antenna for receiving an AM broadcast wave.

BACKGROUND ART

Audio equipment is normally includes a receiving function for receiving AM radio broadcasting and FM radio broadcasting. Among them, for example, some equipment supposed to be used indoors has a structure that a separated antenna for receiving AM/FM radio broadcasting can be installed.

Various antennas for receiving AM/FM radio broadcasting to be used for the above-mentioned audio equipment have been proposed. For example, as an antenna for receiving FM radio broadcasting, for example, a simplified antenna called as a feeder antenna or a wire antenna is well known. Moreover, as an antenna for receiving AM radio broadcasting, an antenna composed of a plastic or the like and a lead wire wound around the plastic or the like is known.

However, the FM simplified antenna mentioned above has a line portion, such as a feeder or a wire, of about 1–2 m in length.

Consequently, when such an FM simplified antenna is installed to be used in audio equipment, it in necessary to expand the line portion to arrange it. Hence, the FM simplified antenna mars the appearance of the room in which the antenna is installed.

Moreover, in a case where an AM antenna and an FM antenna are separately configured, their connection with equipment is troublesome, and the antennas are difficult to handle.

Accordingly, the following antenna has been proposed as an antenna for receiving AM/FM radio broadcasting. According to the disclosure, an AM antenna is formed by winding an antenna coil around a magnetic material rod made of a ferrite, for example, in the shape of a solenoid, and a loop antenna for FM is formed by winding an enamel wire in a shape of a quadrilateral. Then, the AM antenna is arranged in parallel with one side of the FM antenna, and the AM antenna and the FM antenna are formed to be one body by fixing the AM antenna to the FM antenna with a mold resin (Japanese Patent Application Publication (KOKAI) No. SHO 56-122204 (FIG. 3)).

However, because the AM/FM antenna disclosed in Japanese Patent Application Publication (KOKAI) No. SHO 56-122204 mentioned above needs to fix the AM antenna and the FM antenna with each other by means of the mold resin, a process for molding the AM antenna and the FM antenna is needed at the time of manufacturing the AM/FM antenna. Moreover, the mold resin is needed as an antenna material.

Consequently, the AM/FM antenna disclosed in Japanese Patent Application Publication (KOKAI) No. SHO 56-122204 (FIG. 3) is not good in manufacturing efficiency thereof, and entails large cost for realizing the antenna.

Accordingly, the present invention was made in view of the problems described above, and aims to provide an antenna apparatus composed of an AM antenna and an FM antenna united to be one body more efficiently in manufacturing cost or cost.

DISCLOSURE OF THE INVENTION

For achieving the object described above, an antenna apparatus of the present invention includes a first antenna equipped with a first antenna conductor formed in a loop for receiving an electric wave having a first frequency band, and a second antenna equipped with a second antenna conductor for receiving an electric wave having a second frequency band, in which the second antenna conductor is provided to be along the loop in correspondence with a portion as the first antenna conductor.

According to the present invention as mentioned-above, the second antenna conductor is provided to be along the loop in correspondence with the portion as the first antenna conductor. Thereby, the second antenna conductor can be provided to be fixed by means of the portion of the first antenna conductor as a base.

BEST MODES FOR IMPLEMENTING THE INVENTION

In the following, an antenna apparatus as an embodiment of the present invention is described.

Figure 1:
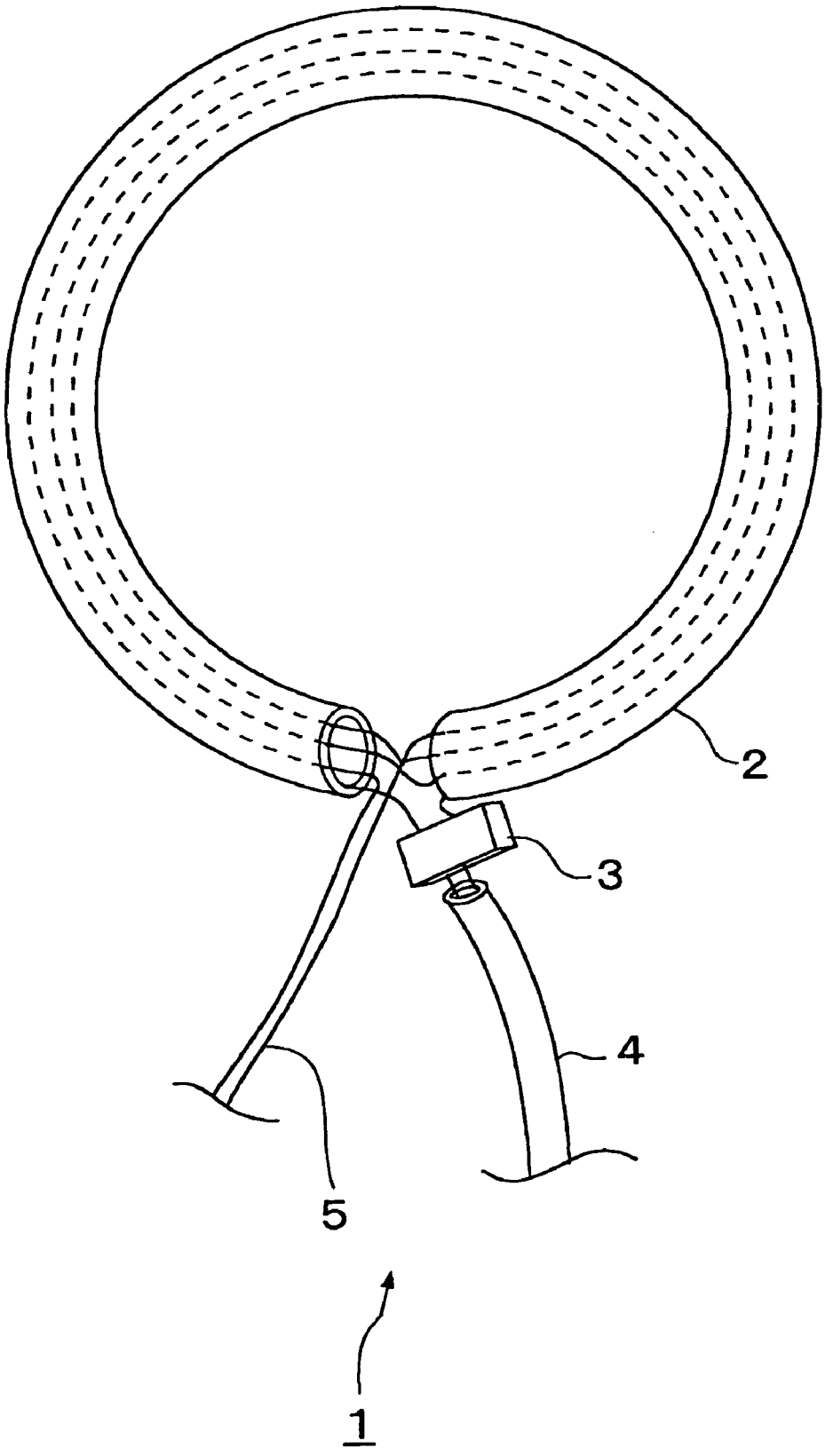
FIG. 1 is a perspective view of an antenna apparatus of an embodiment of the present invention.
Figure 2A:
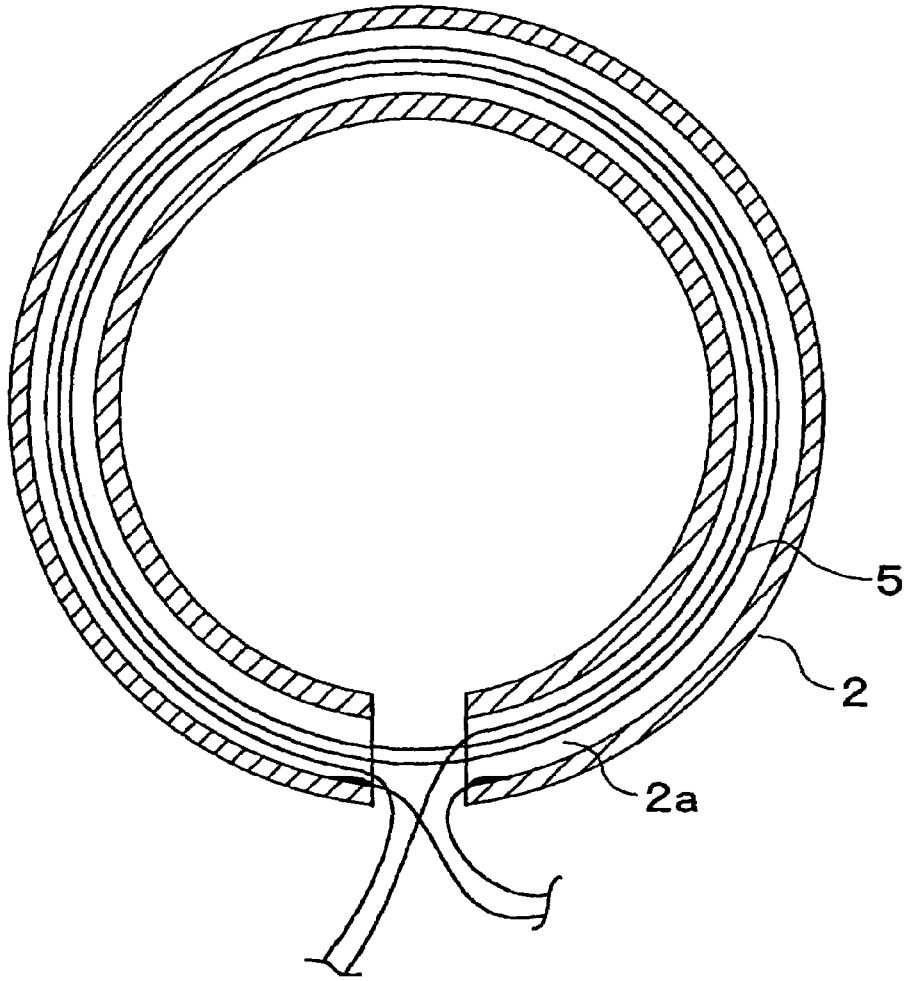
FIG. 2A to FIG. 2B are cross sectional views of the antenna apparatus of the embodiment.
Figure 2B:
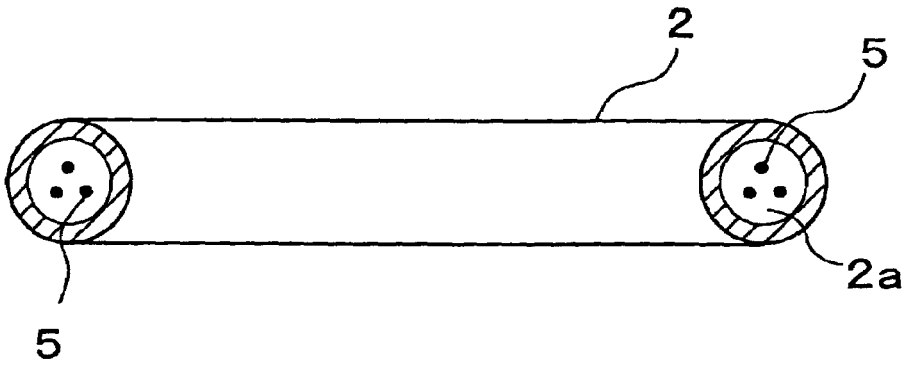

First, a structure of the antenna apparatus as the embodiment of the present invention is described by referring to FIGS. 1, 2A and 2B.

FIG. 1 is an external perspective view showing an external structure of the antenna apparatus of the present embodiment. FIGS. 2A and 2B are cross sections showing an internal structure of the antenna apparatus.

An antenna apparatus 1 shown in FIGS. 1, 2A and 2B is composed of an FM antenna for receiving FM radio broadcasting using an electric wave having a very high frequency (VHF) band as a first frequency band, and an AM antenna for receiving AM radio broadcasting using an electric wave having a medium frequency (MF) band as a second frequency band.

In this case, the FM antenna is composed of an FM antenna conductor 2 and a tuning circuit 3. Moreover, the AM antenna is composed of an AM antenna conductor 5.

The FM antenna conductor 2 is an antenna member having high electric conductivity, and is formed by a metal pipe which is made of a metal such as aluminum and is shaped in almost a column in the inside of which a hollowed space portion 2*a* is formed. Then, after such a metal pipe is molded into, for example, a shape of a loop, the FM antenna conductor 2 is formed by cutting a part of the metal pipe. The tuning circuit 3 for impedance matching is connected to the cut portion of the FM antenna conductor 2.

The loop length of the FM antenna conductor 2 in this case is set to be, for example, a quarter of the wavelength of a target frequency f. For example, if the target frequency f is 100 MHz, the loop length of the FM antenna conductor 2 is about 0.75 m (c/f where c denotes the light speed), and the diameter of the FM antenna conductor 2 molded in a loop is about 0.25 m.

The tuning circuit 3 is for tuning a resonance frequency of the FM antenna to a desired frequency. Incidentally, the electric circuit configuration of the tuning circuit 3 will be described later.

A coaxial cable 4 is used as a cable for transmitting an airwave in a FM band which airwave has been received by the FM antenna composed of the FM antenna conductor 2 and the tuning circuit 3 as described above to an FM input terminal of a radio broadcasting receiver of not-shown audio equipment. In such a case where the FM antenna and the FM input terminal of the radio broadcasting receiver of the audio equipment are connected with each other by means of a shielding wire such as the coaxial cable as described above, noises radiated in the transmission path connecting the FM antenna with the FM input terminal of the radio broadcasting receiver of the audio equipment can be reduced.

On the other hand, the AM antenna conductor 5 is made of, for example, a linear conductor to be housed in the space portion 2*a* of the FM antenna conductor 2. In this case, the AM antenna conductor 5 is formed by being wound a plurality of times, for example about three times, in the space portion 2*a* of the loop-shaped metal pipe being a portion of the FM antenna conductor 2.

Then, also the AM antenna conductor 5 is configured to perform transmission to audio equipment through, for example, a coaxial cable, which is not shown in the drawing. Also in this case, when the AM antenna conductor 5 and an AM input terminal of a radio broadcasting receiver of audio equipment are connected with each other by means of a shielding wire such as a coaxial cable, noises radiated in a transmission path connecting the AM antenna conductor 5 with the AM input terminal of the radio broadcasting receiver of the audio equipment can be reduced.

As described above, in the antenna apparatus 1 of the present embodiment, the FM antenna conductor 2 is made of a metal pipe molded in a loop, and the AM antenna conductor 5 is housed in the space portion 2*a* inside of the metal pipe. Thereby, the antenna apparatus 1 achieves unification of an AM antenna and an FM antenna without using any mold resin as in the related art.

If the antenna apparatus 1 is configured in such a way, a process of molding an AM antenna and an FM antenna with a mold resin becomes unnecessary at the time of manufacturing an antenna apparatus. Consequently, the manufacturing process is simplified, and the manufacturing cost can be reduced by the degree of the simplification. Moreover, with regard to the materials, the mold resin becomes unnecessary. Consequently, the cost can be reduced also from that aspect. As a result, the cost of the antenna apparatus uniting an AM antenna and an FM antenna in a body can be remarkably reduced.

Figure 3A:
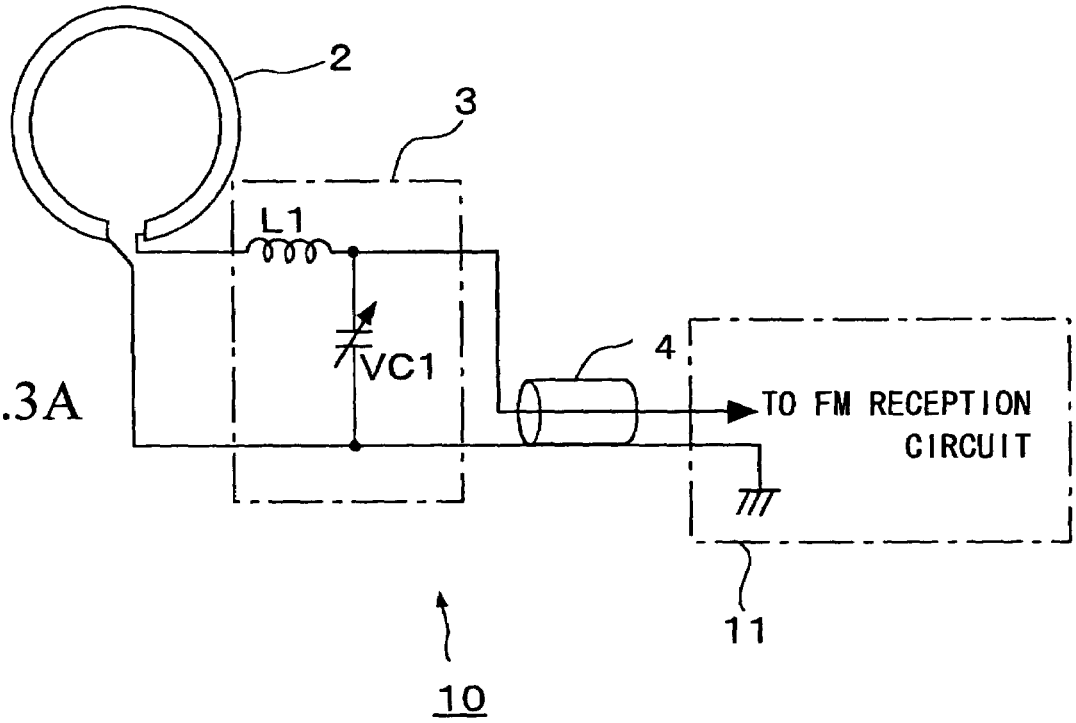
FIG. 3A to FIG. 3B are views showing electric circuit configurations of the antenna apparatus of the embodiment.
Figure 3B:
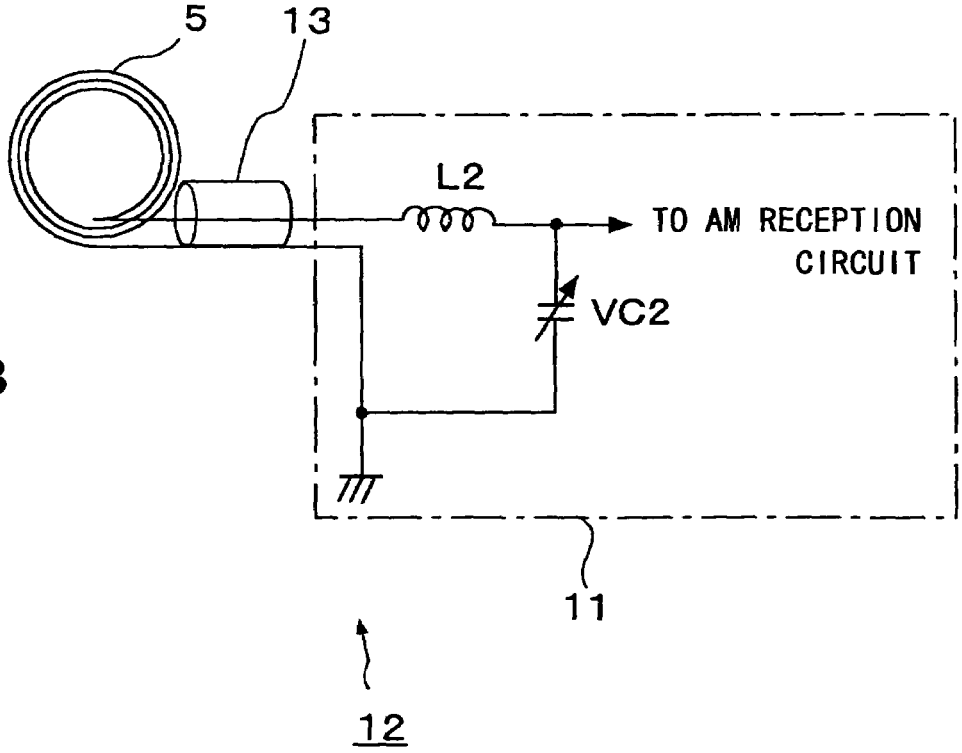

Next, FIGS. 3A and 3B are referred to while the electrical configuration of the antenna apparatus of the present embodiment is described.

FIGS. 3A and 3B are views showing the circuit configuration of the antenna apparatus 1. FIG. 3A shows the configuration of the FM antenna, and FIG. 3B shows the configuration of the AM antenna.

An FM antenna 10 shown in FIG. 3A is composed of the FM antenna conductor 2 and the tuning circuit 3.

The tuning circuit 3 is composed of, for example, a series circuit of a coil L1 for impedance matching and a variable capacitor VC1 for FM tuning. The tuning circuit 3 is configured in order that the resonance frequency of the FM antenna 10, which is determined by the capacitance of the variable capacitor VC1, the inductance of the coil L1 and the inductance of the FM antenna conductor 2, may be tuned to a desired frequency by the changing of the capacitance of the variable capacitor VC1.

The tuning circuit 3 is, as shown in the drawing, connected to both ends of the FM antenna conductor 2. Then, the connection line of the coil L1 and the variable capacitor VC1 is connected to, for example, the FM input terminal of a radio broadcasting receiver 11 provided to audio equipment through the coaxial cable 4. Moreover, the connection line of the variable capacitor VC1 and the FM antenna conductor 2 is connected to an earth E of the radio broadcasting receiver 11 through the coaxial cable 4. In this case, the inductance value of the coil L1 is set to a value of one over several of the value of the inductance of the FM antenna conductor 2, and then the inductance of the FM antenna conductor 2 is dominant in comparison with the inductance of the coil L1.

The FM antenna 10 having such a configuration is known as a tuning type antenna having a tuning frequency to be determined on the basis of the coil L1 and the variable capacitor VC1 of the tuning circuit 3. Moreover, such a tuning type antenna is also called as a so-called magnetic loop antenna being a kind of magnetic-field antennas, and is known as one having antenna performance almost equal to that of a half-wave dipole antenna, though the magnetic loop antenna is small in shape.

That is to say, even if the loop length of the FM antenna conductor 2 is minimized to be ¼ of a wavelength, and even if the diameter of the FM loop antenna is minimized to be about a ¼π (about 0.08) of a wavelength, then the antenna performance of the FM antenna equal to that of a half-wave dipole can be obtained.

On the other hand, as for an AM antenna 12 shown in FIG. 3B, the AM antenna conductor 5 is connected to the radio broadcasting receiver 11 through a coaxial cable 13. Then, a series circuit which is composed of a coil L2 for impedance matching and a variable capacitor VC2 for AM tuning and is provided inside of the radio broadcasting receiver 11 is connected to both ends of the AM antenna conductor 5. The AM antenna 12 is configured to be tuned by the changing of the capacitance of the variable capacitor VC2.

In this case, for example, the inductance value of the AM antenna conductor 5 is set to be 18 μH, and the inductance value of the coil L2 is set to be 450 μH. That is to say, the setting of the inductance value of the AM antenna conductor 5 to be a fraction of an inductance value of the coil L2 makes the inductance of the coil L2 dominant in comparison with the inductance of the AM antenna conductor 5 in the AM antenna 12.

Then, the antenna apparatus 1 of the present embodiment is configured so that the FM antenna conductor 2 of the FM antenna 10 has almost earth electric potential against an electric wave of AM broadcasting using a medium frequency band by the connection of the earth of the FM antenna 10 to the earth of the radio broadcasting receiver 11 of the audio equipment, as shown in FIG. 3A described above.

Consequently, if the AM antenna conductor 5 is housed in the space in the inside of the metal pipe being the FM antenna conductor 2 and the periphery of the AM antenna conductor 5 is covered by the FM antenna conductor 2 as the present embodiment, the AM antenna conductor 5 is electrostatically shielded by the FM antenna conductor 2.

As a result, even if conducted high frequency noises from the audio equipment and the peripheral equipment thereof to which the antenna apparatus 1 is connected are radiated from the AM antenna as those pieces of equipment have been digitalized, it is possible to prevent the noises from being received as disturbing electric waves.

Such noise interference in an AM antenna is conventionally known as the interference to be generated in a case where an AM antenna having a normal structure is connected to audio equipment or the like, for example, in a case where an AM antenna which has a non-shielded structure and a length of about 1 m is connected to the AM input terminal of a radio broadcasting receiver of audio equipment. Then, it is also known that the means for solving such a defect is to shield the AM antenna electrostatically.

However, as a matter of fact, while separate equipment of a shielding component for the electrostatic shielding of an AM antenna brings up sharp increase of a cost, the reduction effect of disturbing electric waves owing to conduction high frequency noises is small. Accordingly, it is the present condition that the electrostatic shielding of an AM antenna has been adopted only by some pieces of audio equipment.

On the contrary, the antenna apparatus 1 of the present embodiment, as described above, has the structure in which the AM antenna conductor 5 is housed in the space portion 2*a* of the FM antenna conductor 2 and the AM antenna conductor 5 is electrostatically shielded by the FM antenna conductor 2. That is to say, the structure can utilize the FM antenna conductor 2 also as an electrostatic shielding component of the AM antenna. Consequently, the antenna apparatus 1 of the present embodiment also has an advantage that it is possible to reduce the noise interference from the AM antenna without increasing the cost thereof.

Incidentally, even if the AM antenna conductor 5 is housed in the space portion 2*a* of the FM antenna conductor 2 as the present embodiment, the impedance of the AM antenna conductor 5 is sufficiently high in the frequency band of the FM broadcast wave (VHF band), and the AM antenna conductor 5 does not affect on the performance of the FM antenna equipped with the FM antenna conductor 2.

Moreover, because a part of the FM antenna conductor 2 constituting the FM antenna is cut and the capacitance of the variable capacitor VC1 of the tuning circuit 3 provided in the cut portion is about several tens pF, the FM antenna conductor 2 does not affect on the performance as the AM antenna equipped with the AM antenna conductor 5.

As described above, the antenna apparatus 1 of the present embodiment electrically utilizes the difference between the frequency band of the AM broadcasting and the frequency band of the FM broadcasting to prevent the performance of one antenna from being affected by the other antenna mutually, and thereby realizes the unification of the AM antenna and the FM antenna.

Incidentally, Japanese Patent Application Publication (KOKAI) No. SHO 56-122204 states that an FM antenna and an AM antenna can be configured in a coaxial state, but does not state any concrete configurations. According to the disclosed contents in Japanese Patent Application Publication (KOKAI) No. SHO 56-122204, even if an FM antenna and an AM antenna are coaxially arranged, it is necessary to fix the FM antenna and the AM antenna structurally by means of a mold resin. Consequently, it is obvious that cost is entailed at the time of manufacturing an AM/FM complex antenna.

Moreover, because the FM antenna is considered to have low impedance at the AM frequency band electrically, the AM antenna is considered to be short-circuited by the FM antenna and the performance of the AM antenna is remarkably deteriorated to make the AM antenna poor in practical use when the FM antenna and the AM antenna are coaxially arranged.

Moreover, the structure of the FM antenna of Japanese Patent Application Publication (KOKAI) No. SHO 56-122204 is clearly different from the structure of the FM antenna of the present embodiment. That is to say, it is obviously different from the FM antenna of the present embodiment made of a magnetic loop antenna, which can have the performance almost equal to that of a dipole antenna.

Figure 4A:
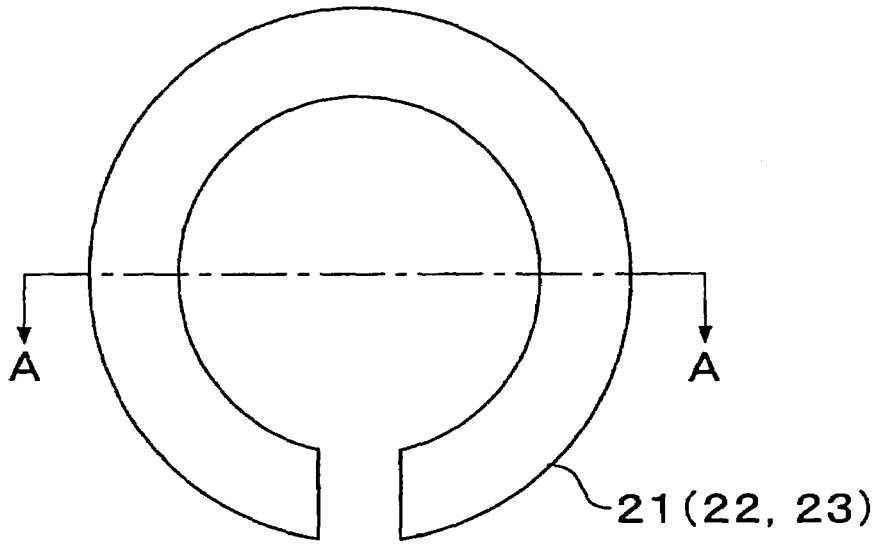
FIG. 4A to FIG. 4D are views showing other cross sectional examples of the antenna apparatus of the embodiment.
Figure 4B:
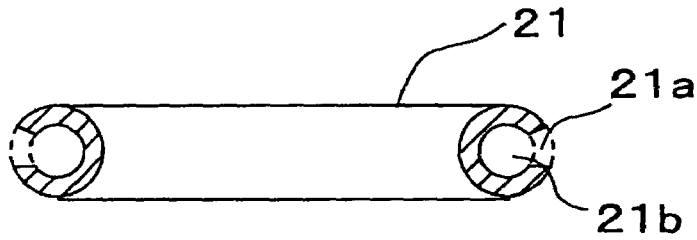

FIGS. 4A to 4D are views showing other examples of the structure of the antenna apparatus of the present embodiment. FIG. 4A is a side view of an FM antenna conductor showing another example of the structure of the antenna apparatus. FIG. 4B is a view of the cross section seen from the direction of arrows A—A at a part of a chain line shown in FIG. 4A. Incidentally, because the structure other then the FM antenna conductor is the same as that of the antenna apparatus shown in FIGS. 1–2B, the structure other than the FM antenna conductor is omitted from being shown.

An FM antenna conductor 21 having the structure shown in FIGS. 4A and 4B forms a notched portion 21*a* along the loop of a metal pipe formed as an electrically conductive member in the shape of a substantial column. In such an FM antenna conductor 21, the AM antenna conductor 5 which is not shown in these drawings can be wound along a space portion 21*b* of the FM antenna conductor 21 by means of the notched portion 21*a* of the FM antenna conductor 21 when the AM antenna conductor 5 is housed in the space portion 21*b* of the FM antenna conductor 21. That is to say, the AM antenna conductor 5 can be easily wound around the periphery of the FM antenna conductor 21.

It is noted that the width of the notch of the notched portion 21*a* of the FM antenna conductor 21 shown in FIG. 4B, and the like can be arbitrarily set in consideration of the shielding effect of the FM antenna conductor 21 to the AM antenna conductor 5, and the like.

Moreover, the cross sections of the column shapes of the FM antenna conductors 2(21) of the antenna apparatus 1 of the present embodiment described above are made to be cylindrical. However, the shapes are examples to the last. The FM antenna conductor may be formed to be columns having the other cross sectional shapes.

Figure 4C:
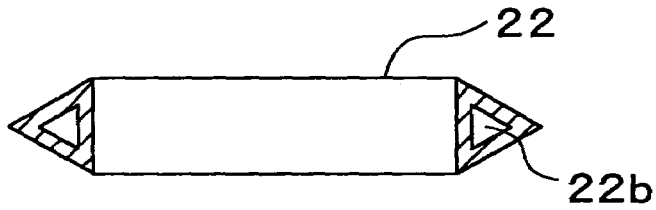
Figure 4D:
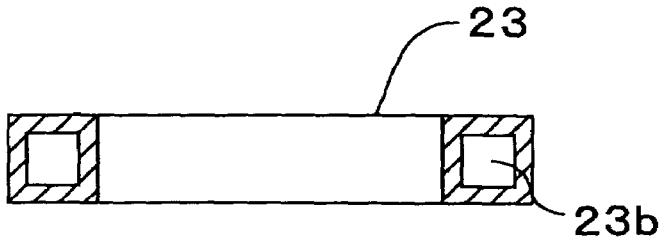

For example, it is also possible to form the antenna apparatus 1 by means of an FM antenna conductor 22 having a cross section of a triangle as shown in FIG. 4C, or an FM antenna conductor 23 having a cross section of a quadrilateral as shown in FIG. 4D.

Moreover, even in a case of an FM antenna conductor having a cross sectional shape such as the one shown in FIG. 4C or 4D other than the cylindrical cross sectional shape, a notched portion formed along the loop of the FM antenna conductor would make it easy to house the AM antenna conductor 5 in the space portion 22*b* or 23*b* thereof.

Moreover, the FM antenna conductor of the present embodiment is formed by molding a metal pipe in a loop, or a notched portion is formed along the loop of the metal pipe molded in a loop. However, the formation is only an example. For example, it is also possible to form an antenna member having a space portion by bending a long and narrow flat plate-like metal conductor into a shape of a letter O, C or U, and to mold such a conductive member in a loop.

Figure 5A:
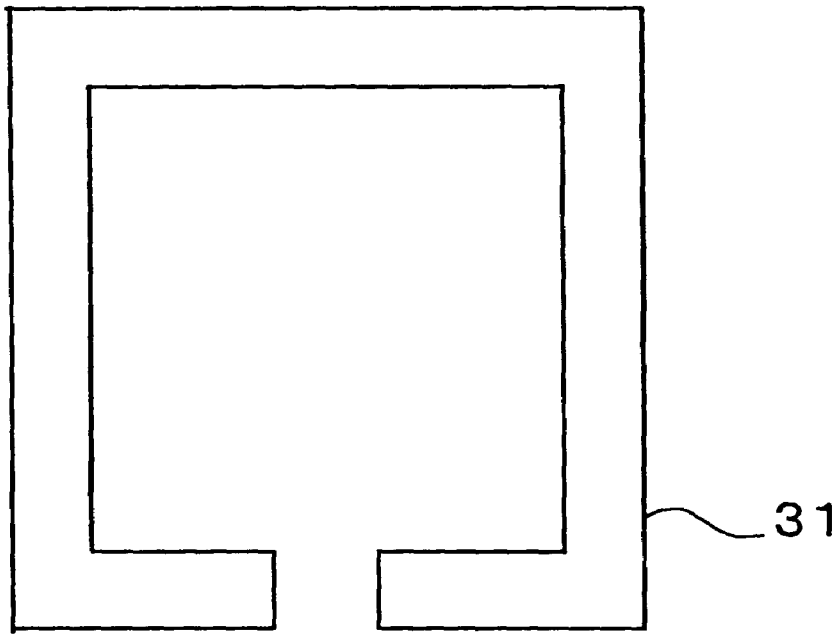
FIG. 5A to FIG. 5B are views showing other examples of loop shape of the antenna apparatus of the embodiment.
Figure 5B:
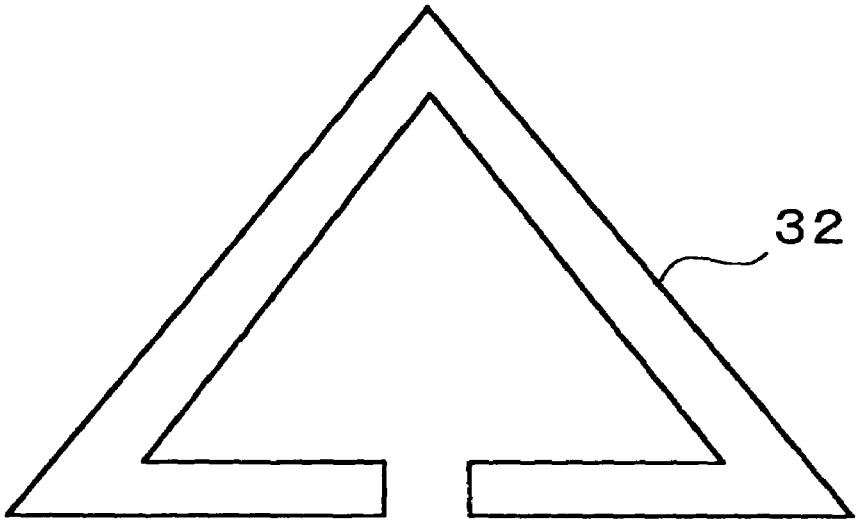

Moreover, the shape of the loop of the FM antenna conductor 2 of the present embodiment described above is almost a ring. However, the shape of the loop of an FM antenna conductor 31(32) to be used for the antenna apparatus 1 may be, for example, a rectangle as shown in FIG. 5A or a triangle as shown in FIG. 5B as long as the loop length of the FM antenna conductor is a quarter of a wavelength of a target frequency. That is to say, the shape of the loop of the FM antenna conductor should not be specifically limited.

As described above, because the antenna apparatus of the present invention disposes a second antenna conductor along the shape of a loop of a portion as a first antenna conductor, it is possible to provide the second antenna conductor on the portion of the first antenna conductor as a base.

Such a united structure of the first antenna and the second antenna would eliminate the use of the process of molding the first antenna and the second antenna with, for example, a mold resin at the time of the manufacturing of the antenna apparatus, and consequently the manufacturing cost of the antenna apparatus can be reduced by that degree. Moreover, because no mold resins are necessary as antenna materials, the cost of components can be also reduced.

As a result, the cost of the antenna apparatus formed by uniting a first antenna and a second antenna is sharply reduced, and consequently it can be said that the cost is largely reduced.

In this way, in the present invention, the efficiency of manufacturing a united antenna is significantly improved.

Moreover, the provision of the second antenna conductor to be housed in the space portion of the first antenna conductor makes the first antenna conductor function as an electrostatic shielding member of the second antenna conductor. That is to say, the unification of the first antenna and the second antenna realizes a structure for performing a measure for noises of the second antenna by means of the first antenna conductor. Consequently, the present invention has an effect capable of implementing the measure of the noises of the second antenna without increasing cost.

The invention claimed is:

1. An antenna apparatus, comprising:

a first antenna equipped with a first antenna conductor formed in a loop for receiving an electric wave in a first frequency band, said first antenna conductor including a conductive antenna member substantially in a shape of a tube having an inner space portion; and a second antenna equipped with a second antenna conductor for receiving an electric wave in a second frequency band, said second antenna conductor being housed in said inner space portion of said first antenna conductor.

2. The antenna apparatus according to claim 1, wherein said first antenna conductor is provided with a notched portion on said conductive antenna member in a cylindrical shape along said loop.

3. The antenna apparatus according to claim 1, wherein said first antenna is a magnetic loop antenna.

* * * * *

UNITED STATES PATENT AND TRADEMARK OFFICE

CERTIFICATE OF CORRECTION

PATENT NO. : 7,129,905 B2
APPLICATION NO. : 10/511060
DATED : October 31, 2006
INVENTOR(S) : Sosumu Morioka It is certified that error appears in the above-identified patent and that said Letters Patent is hereby corrected as shown below:

Title Page, (75), "Sosumu Morioka" should read --Susumu Morioka--
Column 1, line 11, "equipment is normally" should read --equipment normally--
Column 1, line 14, "supposed to be used" should read --to be used--
Column 1, line 14, "separated" should read --separate--
Column 1, line 16, "installed." should read --installed onto.--
Column 1, line 30, "it in necessary" should read --it is necessary--
Column 2, line 10, "as the" should read --of the--
Column 2, line 14, "as the" should read --of the--
Column 3, line 9, "in a FM" should read --in an FM--
Column 5, line 34, "as the present" should read --as in the present--
Column 5, line 37, "dose not affect on the" should read --dose not affect the--
Column 5, line 43, "dose not affect on the" should read --does not affect the--
Column 6, line 18, "other then" should read --other than--
Column 6, line 36, "and the like" should read --and the like,--
Column 7, line 2, "FIG. 5B" should read --FIG. 5B,--

Signed and Sealed this

Sixteenth Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,129,905 B2
APPLICATION NO. : 10/511060
DATED : October 31, 2006
INVENTOR(S) : Sosumu Morioka It is certified that error appears in the above-identified patent and that said Letters Patent is hereby corrected as shown below:

Title Page, (75), "Sosumu Morioka" should read --Susumu Morioka--
Column 1, line 11, "equipment is normally" should read --equipment normally--
Column 1, line 14, "supposed to be used" should read --to be used--
Column 1, line 14, "separated" should read --separate--
Column 1, line 16, "installed." should read --installed onto.--
Column 1, line 30, "it in necessary" should read --it is necessary--
Column 2, line 10, "as the" should read --of the--
Column 2, line 14, "as the" should read --of the--
Column 3, line 9, "in a FM" should read --in an FM--
Column 5, line 34, "as the present" should read --as in the present--
Column 5, line 37, "dose not affect on the" should read --dose not affect the--
Column 5, line 43, "dose not affect on the" should read --does not affect the--
Column 6, line 18, "other then" should read --other than--
Column 6, line 36, "and the like" should read --and the like,--
Column 6, line 51, "shape such" should read --shape other than the cylindrical cross sectional shape, such--
Column 6, line 52, delete "other than the cylindrical cross sectional shape"
Column 7, line 2, "FIG. 5B" should read --FIG. 5B,--

This certificate supersedes the Certificate of Correction issued September 16, 2008.

Signed and Sealed this

Twenty-second Day of December, 2009

David J. Kappos

David J. Kappos
*Director of the United States Patent and Trademark Office*